United States Patent [19]

Bishop

[11] Patent Number: 4,482,133

[45] Date of Patent: Nov. 13, 1984

[54] PNEUMATIC WINCH

[76] Inventor: Carl D. Bishop, 454 Caruthers St., Tallmadge, Ohio 44278

[21] Appl. No.: 486,856

[22] Filed: Apr. 20, 1983

Related U.S. Application Data

[63] Continuation of Ser. No. 254,668, Apr. 16, 1981, abandoned.

[51] Int. Cl.[3] ..... B66D 1/76

[52] U.S. Cl. ..... 254/291

[58] Field of Search ..... 254/291, 359, 314; 242/45, 54 R; 226/195; 405/173, 166, 158, 165

[56] References Cited

U.S. PATENT DOCUMENTS

| | | | |
|---|---|---|---|
| 2,459,064 | 1/1949 | Davis | 242/45 |
| 2,682,997 | 7/1954 | Magnuson et al. | 242/54 R X |
| 2,915,254 | 12/1959 | Weber et al. | 242/45 |
| 3,168,287 | 2/1965 | Parola | 254/290 X |
| 3,240,474 | 3/1966 | Garnier | 254/360 |
| 3,469,801 | 9/1969 | Hauck et al. | 242/54 R |
| 3,682,410 | 8/1972 | Rinearson | 242/45 X |
| 3,907,233 | 9/1975 | Uncapher | 242/54 R X |
| 4,037,823 | 7/1977 | Thaeter et al. | 254/360 |
| 4,194,702 | 3/1980 | Ploeg | 242/54 R X |
| 4,195,791 | 4/1980 | Frazee, Jr. | 242/45 |
| 4,223,871 | 9/1980 | Braithwaite | 254/291 |
| 4,234,167 | 11/1980 | Lane | 254/291 |

*Primary Examiner*—Philip R. Coe
*Assistant Examiner*—Frankie L. Stinson
*Attorney, Agent, or Firm*—Oldham, Oldham, Hudak & Weber Co.

[57] ABSTRACT

A pneumatic winch apparatus applies a constant and non-jerking pull to a cable. The amount of pull or load applied to the cable is determined by the air pressure supplied to an air motor and the radius of a drive wheel connected thereto. A maximum cable-pull load can thus be applied with an automatic non-mechanical cutoff so that a load sensitive cable, such as a fiber optics cable, is not damaged during installation thereof. Moreover, the maximum load is maintained once it has been reached.

1 Claim, 2 Drawing Figures

PNEUMATIC WINCH

This is a continuation of application Ser. No. 254,668, filed Apr. 16, 1981, now abandoned.

TECHNICAL FIELD

The present invention relates to a pneumatic winch. More specifically, the present invention relates to a winch which exerts a constant pull and automatically and gradually stops pulling a cable at a predetermined cable load while maintaining the load.

BACKGROUND ART

Heretofore, winches have been utilized to install cables such as electrical cables or phone cables, hoses, and the like. The cables have an inherent load strength above which they will be damaged or literally broken. The prior art cable installer apparatus have operated on the principal of mechanical engagement or a hydraulic system wherein a positive load was applied. Although some of these devices had automatic or maximum pulling load cutoff devices, due to the positive engagement of the apparatus, the maximum pulling loads or values were often exceeded for brief periods of time which usually resulted in damage to the cable. Moreover, the prior art devices did not always pull constantly, but often with surges or jerks which, depending upon the severity of the surge, would strain, damage, or even break the cable. The hydraulic devices were and still are affected by the temperature changes which affect the viscosity of the fluid and hence the maximum load applied. Such devices are undesirable in pulling a sensitive load cable, such as a fiber optics cable wherein high cable loads or sudden surge loads 35, cannot be applied in that the cable is easily damaged. Moreover, due to the fact that such cables are lengthy and very costly. It is very difficult, time consuming, and expensive to splice such a damaged cable.

DISCLOSURE OF INVENTION

It is therefore an object of the present invention to provide a pneumatic winch.

It is another object of the present invention to provide a pneumatic winch, as above, wherein a constant and non-jerky pull is applied to a cable.

It is yet another object of the present invention to provide a pneumatic winch, as above, wherein no positive or mechanical engagement exists between a drive wheel and the generated force.

It is yet another object of the present invention to provide a pneumatic winch, as above, in which the pull load or force applied to the cable is automatically limited to a specific maximum value.

It is yet another object of the present invention to provide a pneumatic winch, as above, in which the cable is gradually slowed as the maximum cable pull load or force is reached, and the maximum load is maintained.

It is yet another object of the present invention to provide a pneumatic winch, as above, in which the load limit is selectively predetermined.

It is yet another object of the present invention to provide a pneumatic winch, as above, wherein said pneumatic winch comprises a compressor, an air pressure regulator, an air motor, and a drive wheel connected to said air motor.

It is yet another object of the present invention to provide a pneumatic winch, as above, in which said predetermined maximum load limit is regulated by generally the air pressure and the drive wheel diameter.

It is yet another object of the present invention to provide a pneumatic winch, as above, wherein said components are mounted on a frame.

It is yet another object of the present invention to provide a pneumatic winch, as above, in which said device includes a wind-up roll for storing a retrieved leader cable, said wind-up roll applying a slight tension to said cable.

It is yet another object of the present invention to provide a pneumatic winch, as above, including a flow control valve for regulating the rate of air admitted to said air motor.

It is yet another object of the present invention to provide a pneumatic winch, as above, including a process for applying a constant pull to a cable, as well as limiting and maintaining the maximum cable pull load.

It is yet another object of the present invention to provide a pneumatic winch, as above, wherein said pulled cable is a fiber optics cable.

These and other objects of the present invention will become apparent from the following specifition.

In general, a constant pull pneumatic winch, comprises: a compressor, a pressure regulator, a pneumatic motor, and a drive wheel means for applying a constant pull to a cable; said compressor connected to said pressure regulator and said pressure regulator connected to said pneumatic motor; said pressure regulator regulating the pressure admitted to said motor; and said drive wheel connected to said pneumatic motor so that a constant pull is applied to said cable.

In general, a pneumatic process for applying a constant pull to a cable, comprises the steps of: compressing a pneumatic fluid; regulating the pressure of said pneumatic fluid; applying said regulated pneumatic fluid pressure to a pneumatic motor; and pneumatically driving a drive wheel with said motor so that a constant pull is applied to the cable up to a predetermined maximum pulling load.

BEST MODE FOR CARRYING OUT THE INVENTION

According to the present invention, a pneumatic winch exerts a constant pull upon various items such as a hose, a cable, a leader cable, etc., up to a specific predetermined or selected maximum cable pull load so that the cable, etc., is not damaged. By the term "constant," it is meant that an even or steady pull is exerted upon the cable. That is, there is no jerking, sudden surge of force, or rapid undulating load applied to the cable as is associated with positive displacement cable pullers, for example, mechanical engagement and hydraulic. Moreover, the invention also relates to a gradual slowing of the rate of pull as a selected or predetermined maximum value is approached at which value the pneumatic motor stalls, that is ceases to turn: or rotate the drive wheel and yet maintains the maximum load.

Figure 1:
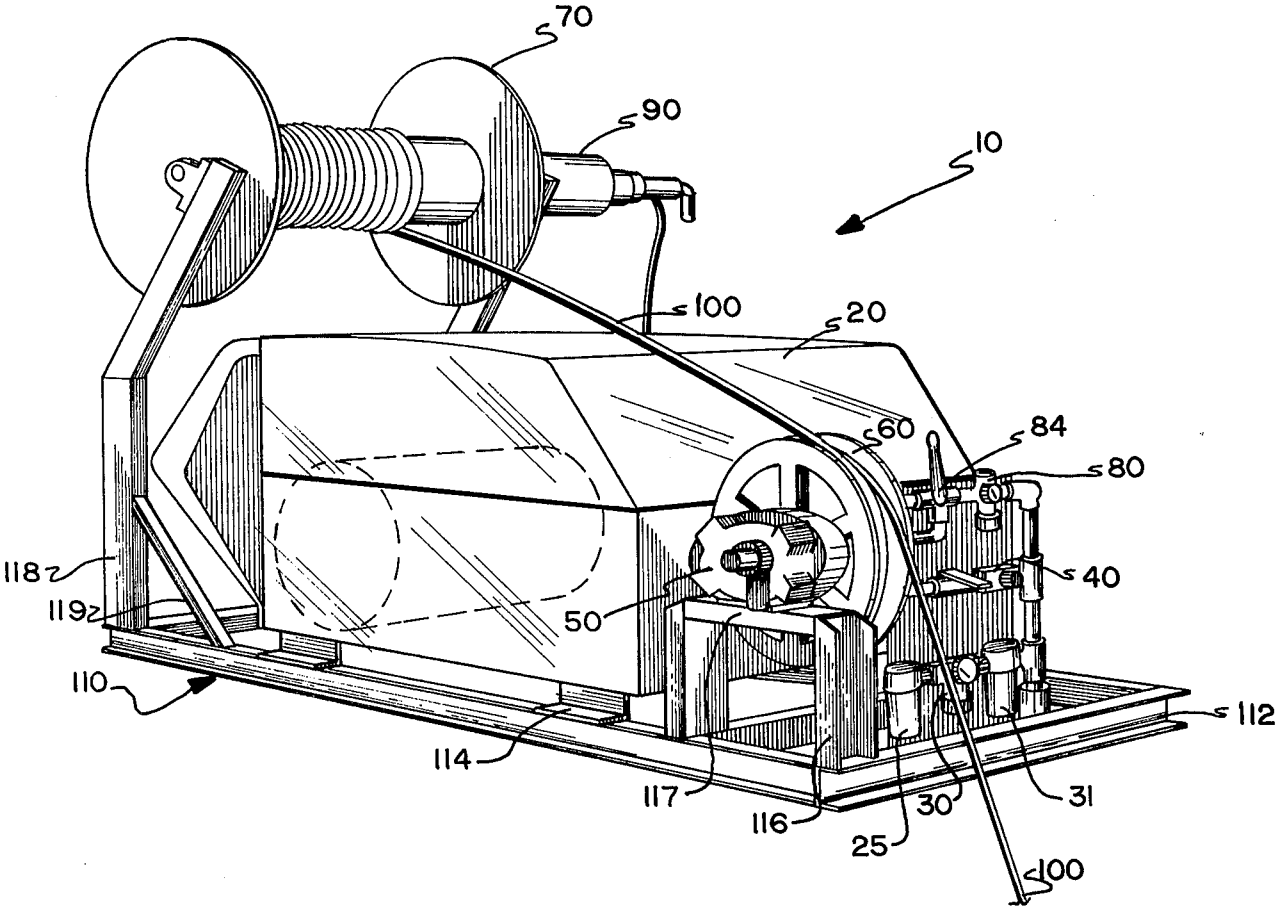
FIG. 1 is a perspective view of a pneumatic winch of the present invention showing the compressor housing, the framework, the pneumatic motor drive, as well as the drive wheel, and the wind-up roll.

Referring to FIG. 1, the basic components of the apparatus and system for exerting a constant pull on a cable are shown. The pneumatic winch is generally indicated by the numeral 10. The apparatus contains a compressor 20, a pressure regulator 30, a flow control valve 40, a pneumatic drive motor 50, and a drive wheel 60. A leader cable 100 is wrapped about the drive wheel a couple of times and is taken off or wound around cable spool 70. The purpose of the cable spool 70 is to apply a slight tension or force to the cable so that cable 100 will grip drive wheel 60 and not slide about it, and to store the leader cable until it is drawn out for another pulling operation. Of course, any tension applying device can be utilized in lieu of spool 70 and motor 90. Spool 70 is driven by air pressure from the air compressor via pneumatic rotor 90 with the air pressure being regulated by air regulated valve 80. The compressor 20, through various conduits, also drives drive wheel 60 via pneumatic motor 50.

As apparent from FIG. 1, the various components of the apparatus and system are mounted upon a frame, generally indicated by the numeral 110. The base portion of the frame 112 is made of a series of steel channels 112. Compressor 20 is connected to steel angle plates 114 which in turn are connected to and reside upon the top of channels 112. The framework also supports pneumatic motor 50 and drive wheel 60 through upwardly extending side channels 116 and top channel 117, to which the motor is connected. Spool 70 is supported upon channel arms 118. Channels 119 extend between the bottom framework and spool channel arms 118 to give rigidity thereto.

Figure 2:
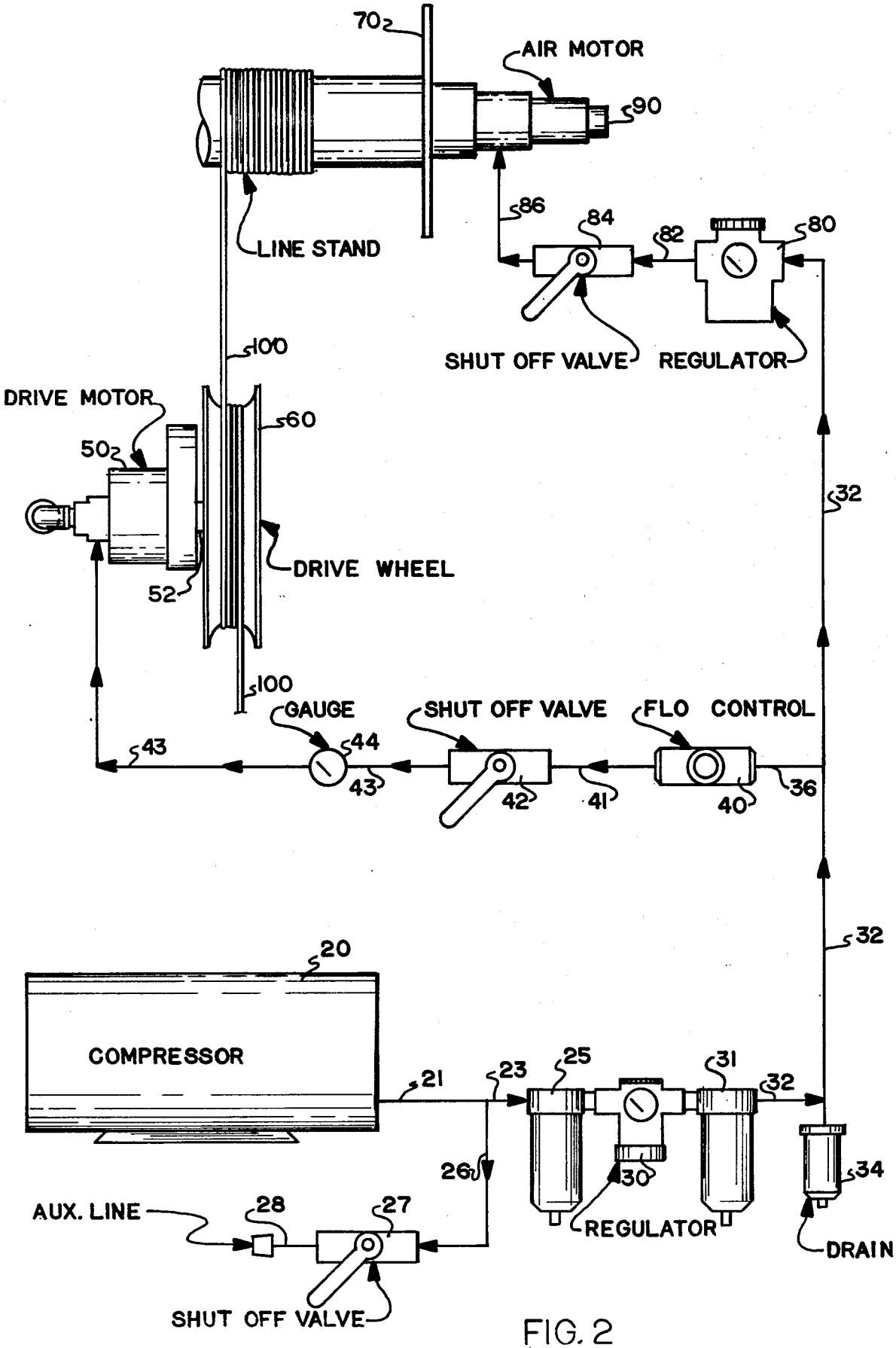
FIG. 2 is a schematic view showing the pneumatic flow and interrelation of the various components of the apparatus.

The interrelationship of the various components and the flow of air of a pneumatic cable puller system is shown in FIG. 2. A compressor compresses a gas, preferably air, to a predetermined level and emits it therefrom through conduit 21 to conduit 23. The air is fed to filter 25 which removes water and foreign debris such as dirt or dust. Pressure regulator 30 regulates the pressure of the air to conduit 32 which flows to the pneumatic motors. An in-line oiler 31 supplies oil to the air for lubrication of the air motors and a drain 34 exists to remove moisture or condensation contained in the conduits. An auxiliary conduit 26, can also exist and supply compressed air to an auxiliary line 28 through shutoff valve 27.

Considering the pneumatic drive motor 50, it is fed through a conduit from line 32. Specifically, conduit 36 supplies the air to a flow control valve 40. The purpose of this valve is to control the flow or rate of air admitted to drive rotor 50 and to permit the winch to obtain its maximum pulling load. In other words, if a slow or fast rate of pull on cable 100 is desired, flow control valve can accordingly be set. Moreover, when the maximum pulling load is desired, valve 40 should be fully opened. From the valve 40 through conduit 41, the air passes through shutoff valve 42 and further continues onward through conduit 43, having a pressure gauge 44 thereon, to pneumatic motor 50. Motor 50 through drive shaft 52 is connected to drive wheel 60. Pneumatic motor 50 may be any conventional or commonly known motor. Thus, the motor, through drive wheel 60, will exert a force or pulling load on cable 100.

Due to the fact that a pneumatic system is utilized, with the pressure of the gas being regulated, a constant or steady force is applied to drive motor 50 and hence, drive wheel 60 exerts a constant or steady line pull on the cable. Even if, for some reason, a sudden surge of pressure is introduced into the pneumatic system by the compressor, such surge will be regulated by regulator valve 30, flow control valve 40, as well as dampened so that the drive wheel exerts a constant and steady load on the cable. Moreover, as previously noted, the upper limit or maximum pulling load exerted by the drive wheel can be accurately controlled at a predetermined value. This is accomplished by adjusting the air pressure through regulator 30 and varying the diameter of drive wheel 60. Naturally, flow control valve 40 will be fully opened to permit the maximum load to be obtained. In other words, the force exerted by the drive wheel is generally directly proportional to the air pressure and inversely proportional to the radius of the drive wheel. Thus, provided that a suitable pressure-producing compressor is provided, the load on cable 100 can be adjusted over a wide range. To ensure that the force is imparted to the cable, it is wrapped about the drive wheel any number of times, usually from about two to about five, and a slight amount of tension is applied thereto by spool 70 so that the cable frictionally grips the drive wheel. Due to the pneumatic system and the arrangement of the components thereof, the pull rate on the cable is gradually reduced until a predetermined or maximum load is reached. At this maximum loading level, the pneumatic motor stalls, that is it does not turn or rotate drive wheel 60 and yet maintains the maximum predetermined load on the cable. The winch apparatus may be kept in the stalled stage, that is maximum applied load, for any length of time.

Pneumatic motor 90 serves to take in or wind the cable which has been pulled in and to apply a slight tension to the cable. Since this motor usually supplies a small pulling load to cable 100, a much lesser amount of air pressure is required. Thus, through air pressure regulator 80, the air from conduit 32 can be suitably adjusted and through conduits 82, shutoff valve 84, and conduit 86, admitted to air rotor 90. The spool diameter can also vary according to the pressure so that a 10 to about a 50 pound or higher pulling force or load is applied to the cable. Although as shown in FIG. 2, the cable takeup pneumatic motor is driven off the same source of compressed air as the drive wheel, it may be driven by a totally independent source. Furthermore, pressure regulator 30 may be located in conduit 36 off the main air pressure conduit 32. Naturally, other changes of location of the various devices may be made without departing from the invention.

The apparatus and system shown in the drawings and described herein has been found to readily pull a fiber optics cable, that is a cable such as that utilized for carrying telephone messages, at a constant pull without any sudden jerks or surges and to a maximum pulling force, such that the fiber optics cable is not damaged. Generally, the apparatus is used as follows. A leader cable is sent from one manhole to another manhole or series of manholes. Then, the cable, for example, a fiber optics cable, is attached to the leader cable and winch 10 started. The fiber optics cable is then pulled by the leader through the conduit by a load exerted on the leader cable by drive wheel 60, with leader cable 100 being wound about spool 70. The process is repeated until the continuous fiber optics cable is installed between two points. The telephone fiber optics cable can have any weight such as approximately 80 pounds per 1,000 feet of cable. The leader cable can be made of metal and coated with plastic and preferably designed such that it weighs approximately the same weight as the fiber optics cable, and has the same frictional drag properties.

As apparent to those skilled in the art, the apparatus may have any desired capacity, pressure, pull load, etc. For example, a Grimmerschmidt compressor may be utilized having a capacity of 125 cubic feet per minute at a pressure of from about 90 to about 120 psi. Regulator 30 can limit the air to about 85 psi with the flow control valve 40 maintaining the cable drive speed at approximately zero or 1 to about 150–200 feet per minute. Drive motor 50 can be a Gardner Denver model, with drive wheel 60 having a 23-inch diameter and made out of cast aluminum. Air motor 90 can be a Gardner Denver model, receiving an air pressure of about 30 to 40 psi. The spool diameter is about 8 inches. Such a system will effectively pull the fiber optics cable at a steady or constant pace without any sudden jerks to a preselected force of a 600-pound line load when flow control valve is fully opened. That is, a 600-pound pulling force on leader line 100. Of course, from the teachings of the invention herein, the system can be designed as by regulating pressure valve 30 or the diameter of drive wheel 60 to pull a greater load or lesser load as desired, as well as by using different size equipment, equipment of different capacity, actually pulling the installed cable, and the like. Naturally, in lieu of fiber optic cables, inner ducts, hoses, cables, and the like may be pulled at a constant or steady pull.

While the best mode and preferred embodiment have been described in detail, in accordance with the patent statutes, it is to be understood that the scope of the invention is set forth by the attached claims.

What is claimed is:

1. A pneumatic winch for applying and maintaining a constant predetermined pulling tension on a lead cable including:

(a) a winding spool for collecting the lead cable;

(b) a first air motor for rotatiing the winding spool to collect the lead cable on said spool;

(c) a first pressure regulator for supplying a predetermined pressure to said motor for rotating the winding spool at a predetermined pressure to apply and maintain a predetermined tension on the lead cable as it is being collected on the winding spool;

(d) a drive wheel;

(e) a second air motor for rotating the drive wheel;

(f) a second pressure regulator for supplying a predetermined pressure to the second air motor for rotating the drive wheel at a predetermined pressure to apply a predetermined tension on the lead cable which is wound about said drive wheel at least one convolution, with said tension exerted on the cable by the drive wheel being greater than the tension exerted on the cable by the winding spool and with said second air motor stalling when the tensions applied to the cable at the drive wheel starts to exceed the predetermined tension supplied thereto by the second regulator to maintain said predetermined tension on the cable;

(g) a flow control valve for controlling the rate of air admitted to the second air motor to regulate the rotational speed of said second air motor and to enable said second air motor to obtain the predetermined tension applied to the drive wheel; and (h) a compressor for supplying pressurized air to the first and second air motors through the regulators.

* * * * *